US007995939B2

(12) United States Patent
Carter, Jr. et al.

(10) Patent No.: US 7,995,939 B2
(45) Date of Patent: Aug. 9, 2011

(54) TONER CALIBRATION MEASUREMENT

(75) Inventors: Albert Mann Carter, Jr., Richmond, KY (US); Gary Allen Denton, Lexington, KY (US); Cary P. Ravitz, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 829 days.

(21) Appl. No.: 11/771,121

(22) Filed: Sep. 25, 2007

(65) Prior Publication Data

US 2009/0080920 A1 Mar. 26, 2009

(51) Int. Cl.
*G03G 15/00* (2006.01)

(52) U.S. Cl. ..... 399/49; 399/72

(58) Field of Classification Search ..... 399/49, 399/72, 39, 40, 41

See application file for complete search history.

(56) References Cited

U.S. PATENT DOCUMENTS 5,103,260 A 4/1992 Tompkins et al.
5,200,783 A * 4/1993 Maeda et al. ..... 399/39
5,512,986 A 4/1996 Toyomura et al.
5,512,988 A * 4/1996 Donaldson ..... 399/120
6,009,285 A 12/1999 Barry et al.
6,123,417 A 9/2000 Bard et al.
6,154,238 A 11/2000 Cook et al.
6,161,921 A 12/2000 Bard et al.
6,254,221 B1 7/2001 Bard et al.
6,560,418 B2 5/2003 Campbell et al.
6,628,398 B1 9/2003 Denton et al.
6,628,426 B2 9/2003 Denton et al.
6,797,218 B1 9/2004 Bickerstaff
7,006,250 B2 2/2006 Denton et al.
7,171,134 B2 1/2007 Denton et al.

* cited by examiner

*Primary Examiner* — David M Gray
*Assistant Examiner* — Gregory H Curran

(57) ABSTRACT

The present disclosure relates to a method, system and apparatus for calibrating an image forming device using a toner patch sensor which emits and detects light in at a given wavelength. A plurality of toner patches may be deposited onto a control surface, wherein the toner patches include a first toner patch including a first toner, a second toner patch including the first toner deposited over a second toner, and a third toner patch including the second toner. Signals indicative of the reflectivity of the plurality of toner patches and the control surface may be measured by emitting light of a given wavelength in the infrared spectrum and detecting the amount of incident light reflected from said plurality of toner patches and said control surface. The signals indicative of reflectivity may then be used to adjust operating parameters of the image forming device which may then control toner mass density.

39 Claims, 5 Drawing Sheets

TONER CALIBRATION MEASUREMENT

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to the measurement of toner density of deposited unfused toner and more particularly to measurement calibration.

2. Description of the Related Art

Electrostatically printed color images may be produced by depositing toners of various colors onto a recording media, such as a sheet of paper. A wide palette of printed colors may be generated by printing yellow, cyan, magenta and black toners in various proportions and combinations. Each individual color of the producible palette may require a specific proportion and combination of toners. If the particular proportions of toner for a selected color cannot be repeatedly deposited on the printed media then the printed color may not be consistent and vary in hue, chroma, and/or lightness from attempt to attempt of printing. The proportion of each toner color to be deposited may be based on the thickness of the toner layer of a given color. Therefore, controlling the printed colors, and ensuring reproducibility of the printed colors, may be achieved by controlling the toner layer thickness to ensure consistent color reproduction.

Toner patch sensors have therefore been used in printers and copiers to monitor the toner density of toner deposited onto a control surface in the printer, such as an intermediate transfer belt. Typically, such sensors may utilize a light source to illuminate a toner patch and the reflectance of the incident light may be measured to indicate the thickness of the toner patch. The sensor may then provide a signal, which the printer may use to adjust the toner density and provide a method of controlling the print darkness. In color printers and copiers, toner patch sensors may be used to maintain the color balance and in some cases to modify the gamma correction or halftone linearization as the electrophotographic process changes with the environment and aging effects.

Some printers, such as the LEXMARK C522, available from Lexmark International, Inc., may use algorithms that rely on the absolute voltage signal levels from the toner patch sensor to adjust the electrophotographic operating parameters in an attempt to control color density. Other printers, like the LEXMARK C750, also available from Lexmark International, Inc., may use algorithms that only use the ratio of the signal level of the test toner patch to the signal level of the bare belt. However, the reflectivity of the bare belt may not be constant over time due to the accumulation of toner resin, wax and extraparticulate particles, and, therefore, the reflectivity of the belt may not be accurately predicted. This problem may degrade the accuracy of the toner patch sensor in printers that use reflection ratios to monitor and adjust color print densities. The mechanical positioning and orientation of toner patch sensor components may also affect the magnitudes of the toner patch signal for both the bare belt and the test patches. Variations in these mechanical factors from one printer to the next often lead to degradation in the accuracy of the color control system for both the ratio method and the absolute voltage method of toner patch signal color control. A color control method is needed that is not sensitive to changes in the reflective characteristics of the intermediate/transport belt or to the precise position and orientation of the toner patch sensor.

SUMMARY OF THE INVENTION

The present disclosure relates to a method, apparatus and system for calibrating an image forming device, wherein the image forming device uses a toner patch sensor which emits and detects light at a given wavelength in the infrared spectrum. In an exemplary embodiment, a plurality of toner patches may be deposited onto a control surface, wherein the toner patches include a first toner patch including a first toner, a second toner patch including the first toner deposited over a second toner, and a third toner patch including the second toner. Signals indicative of the reflectivity of the plurality of toner patches and the reflectivity of said control surface may be measured by the toner patch sensor. The first toner patch may exhibit a reflectivity $R_1$, the second toner patch may exhibit a reflectivity $R_2$, the third toner patch may exhibit a reflectivity $R_3$, and the control surface may exhibit a reflectivity $R_{control}$ wherein $R_{control} \neq R_3$. An operating parameter may then be adjusted based on said measured signals.

In addition, a ratio (Ratio A:B) may then be determined according to the following relationship:

$$\frac{R_2 - R_1}{R_3 - R_{control}} = \text{Ratio}(A{:}B)$$

Again, an operating parameter of the image forming device may then be adjusted based on the ratio, which may then control toner mass density (mass/unit area). The adjustment of such operating parameter may include comparing the determined ratio to a selected value for Ratio (A:B).

Furthermore, an aspect of the present disclosure relates to a method for calibrating an image forming device using a toner patch sensor which emits and detects light at a given wavelength in the infrared spectrum. The method may again include depositing a plurality of toner patches onto a control surface, wherein the toner patches include a first toner patch including a first toner, a second toner patch including the first toner deposited over a second toner, and a third toner patch including the second toner. Signals indicative of the reflectivity of the plurality of toner patches and control surface may be measured by the toner patch sensor. A calculated saturated reflectivity ($R_{sat}$) may then be determined according to the following relationship:

$$R_{sat} = \frac{R_2 R_{control} - R_1 R_3}{R_2 + R_{control} - R_1 - R_3}$$

wherein $R_1$ is a signal indicative of the reflectivity of the first toner patch, $R_2$ is a signal indicative of the reflectivity of the second toner patch, $R_3$ is a signal indicative of the reflectivity of the third toner patch and $R_{control}$ is a signal indicative of the reflectivity of the control surface. An operating parameter of the image forming device may then be adjusted based on the calculated $R_{sat}$ which may then control toner mass density (mass/unit area).

The present disclosure also contemplates a toner cartridge for an image forming device, which may include a reservoir for a first toner and a storage medium having stored thereon a selected saturated reflectivity ($R_{sat}$) for the first toner. The storage medium may be capable of communicating with a controller in the image forming device, wherein the controller may be capable of calculating a calculated saturated reflectivity ($R_{sat}$) according to the following relationship:

$$R_{sat} = \frac{R_2 R_{control} - R_1 R_3}{R_2 + R_{control} - R_1 - R_3}$$

wherein $R_1$ is a signal indicative of the reflectivity of the first toner patch, $R_2$ is a signal indicative of the reflectivity of the second toner patch, $R_3$ is a signal indicative of the reflectivity of the third toner patch and $R_{control}$ is a signal indicative of the reflectivity of the control surface. The controller may also be capable of comparing the calculated $R_{sat}$ for the first toner to a selected $R_{sat}$ for the first toner, determining a difference between the calculated $R_{sat}$ and selected $R_{sat}$ and adjusting an operating parameter related to a second toner and optionally an additional toner based on the difference between the calculated $R_{sat}$ and selected $R_{sat}$.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
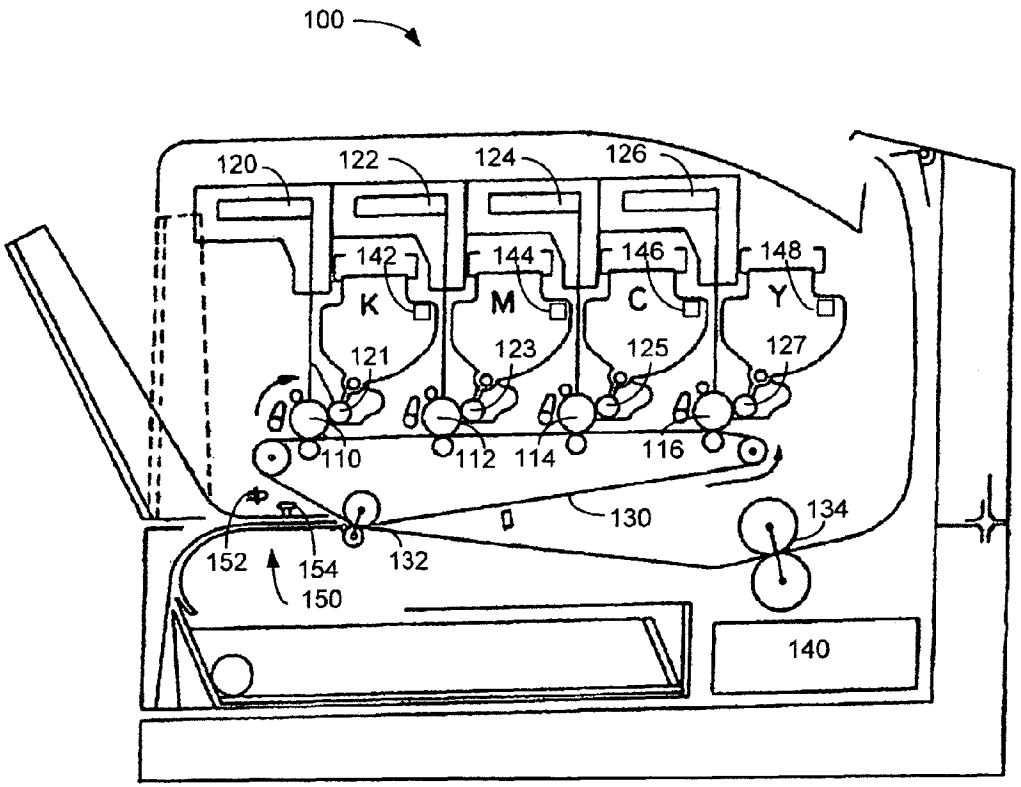
FIG. 1 is an illustration of an exemplary image forming device including a toner patch sensor.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The present invention generally relates to the measurement of deposited unfused toner density and more particularly to the calibration of such measurements, as made by a toner patch sensor. As alluded to above, toner patch sensors may be used in image forming devices wherein an image forming medium, such as ink or particulate toner, may be deposited on a sheet of paper or other material. In addition, the toner may be prepared according to a number of techniques. With regard to electrostatic printing, according to a first technique, a so-called "conventional toner" may be prepared from a toner resin that may be melt mixed with pigment and other additives. The melt mixed toner formulation may be crushed, pulverized, milled, etc., to provide fine particles. Additives may be incorporated onto the toner particle surfaces as an extra particulate additive. According to another technique, "chemically produced toner" may be prepared in which toner particles may be prepared by chemical processes such as aggregation or suspension rather than being abraded from much larger size materials by physical processes.

The image forming apparatus may include an electrophotographic device, ink printer, copier, fax, all-in-one device or multi-functional device. As illustrated in FIG. 1, an exemplary image forming device 100 may include one or more photoconductive drums 110, 112, 114 and 116. Each drum may be charged via a charging device and then selectively discharged by, for example, a laser 120, 122, 124 and 126 to form a latent image thereon. Where multiple colors are utilized in a given image forming device, each latent image may correspond to a color component of the image to be printed.

Image forming media (toner) may be stored in one or more toner cartridges C,M,Y,K. The individual toner cartridges may include a storage device 142, 144, 146, 148 for maintaining information regarding optical or physical characteristics of the toner composition stored therein. The storage devices 142, 144, 146, 148 may be in communication with a controller 140 located within the image forming device 100.

The toner may be transferred from a given cartridge to a sheet of media by depositing the toner onto a photoconductor via differential charging between the toner, a developer roller 121, 123, 125, 127 located within the cartridge and the photoconductor 110, 112, 114 and 116. The image forming media may then be transferred from the photoconductor(s) to an intermediate transfer belt 130. It should be appreciated that at this point, where multiple colors are used, the various color component images are deposited over each other to form a single, multicolor image. The multicolor image may then be transferred by a transfer device 132 and then fused by a fuser 134 to a sheet of paper or other material M.

An image forming device herein may include a closed-loop control system incorporating the controller 140 and one or more toner patch sensors 150 to maintain the proportions of image forming media that may be deposited during the image developing process, i.e., during printing. This may eliminate, or at least reduce, color shifts in printed images. In an exemplary control system, the toner layer thickness may be determined based on a light signal reflected by a printed test pattern. For example, a light source 152 may be used to illuminate solid and grayscale printed patterns, or patches, of the four toners, i.e., yellow, cyan, magenta, and black printed on a control surface, which in the exemplary embodiment may include the intermediate transfer belt 130. However, it should be appreciated that other control surfaces may be utilized herein. The reflected light signal may then be measured using a photodetector or other optical sensor 154, which may provide an indication of the deposited toner layer density or thickness.

One exemplary device herein for monitoring toner density or thickness on an unfused image is the toner patch sensor (TPS) as described in U.S. Pat. No. 6,628,398, whose teachings are incorporated by reference. Accordingly, an infrared light signal reflected by a printed toner layer or test pattern may therefore be generally related to the infrared reflectivity of the toner pigment and to the printed density or toner layer thickness. The TPS may therefore utilize a test patch in combination with a photodiode which may be configured to provide three different scenarios: (1) direct illumination with indirect detection; (2) indirect illumination and detection; and (3) diffuse illumination with direct detection. Relatively accurate density control may therefore be achieved that is substantially independent of a belt surface roughness.

This then may facilitate toner layer thickness control as described more fully below. Such improved toner layer thickness control may therefore lead to improved ability to accurately and repeatedly produce colors of an image developed on a recording media, e.g. a printed image. However, over time, parameters such as light source voltage, age, temperature, sensor distance to the control surface, the angle of the sensor relative to the belt, and light source or detector positioning within the sensor may affect the outcome of the toner patch sensor measurement. Accordingly, the readings obtained by the detector may change over time, thus affecting the degree of adjustment of the operating conditions.

Image forming media (e.g., toner) to be measured for density or thickness may be placed on a control surface that may include the intermediate transfer belt described above. Toner patches, i.e., solid and grayscale toner test patterns, may be printed on the control surface and the control surface may be impinged with light from an infrared light source. At least a portion of the infrared light may be reflected by the toner patches and collected by an infrared detector. The detector may then provide a signal of a given voltage corresponding to the reflectivity of the toner patch to the processor.

The toner layer density and/or thickness may then be determined from the strength of the reflected signal from the toner patches. An exemplary relationship for determining the mass density of the toner, i.e., the amount or mass of toner deposited over a given area (e.g., mg/cm$^2$), is illustrated below.

$$R_{patch}=R_{sat}+(R_{under}-R_{sat})*e^{-kx}$$

wherein $R_{patch}$ may be a signal indicative of reflectivity of the toner patch, $R_{sat}$ may be a signal indicative of reflectivity of a toner layer thick enough that the signal indicative of reflectivity of the toner is independent of the underlying surface, $R_{under}$ may be a signal indicative of reflectivity of the underlying surface, k is the hiding power or degree of opacity of the toner and x is the mass density of the toner (mg/cm$^2$). The underlying surface may be a control surface, $R_{control}$, such as an intermediate transfer belt, or another toner layer upon which the toner is deposited. As alluded to above, the signals indicative of reflectivity may be electrical signals, such as voltage or optical signals.

The above may also be expressed in terms of the reflectivity ratio, i.e., the ratio of the signal indicative of reflectivity of a given toner patch or underlying surface to the signal indicative of the reflectivity of the underlying surface, resulting in the following equation.

$$RR_{patch}=RR_{sat}+(RR_{under}-RR_{sat})*e^{-kx},$$

wherein the reflectivity ratios may be represented by the following:

$$RR_{patch}=\frac{R_{patch}}{R_{belt}},\ RR_{sat}=\frac{R_{sat}}{R_{belt}},\ RR_{under}=\frac{R_{under}}{R_{belt}}.$$

Figure 2:
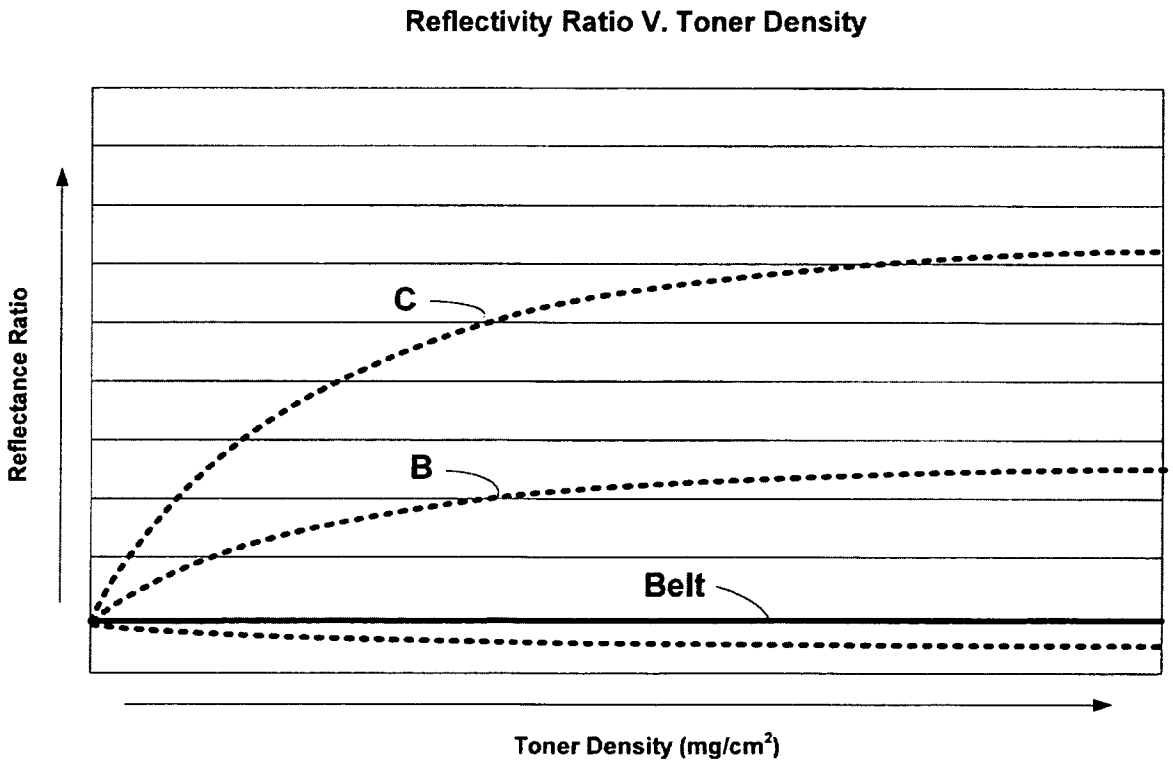
FIG. 2 is a graph illustrating an exemplary relationship between toner density and reflectivity.

Using the above equations, the operating conditions of the printer, such as photoconductor charge, laser discharge intensity, or developer roller bias, may then be adjusted according to the detected toner layer density and/or thickness in order to provide the necessary proportions of toner to achieve a desired color. FIG. 2 illustrates the reflection ratio with respect to toner density. As can be seen in the figures, toner formulations C that are relatively reflective may exhibit a higher degree change in the reflection ratio with respect to changes in toner density than the relatively absorptive toner formulations B. It may also be appreciated that some relatively absorptive toner formulations A may be more absorptive than the belt ("Belt") and as the mass density (mass/area) of the toner increases, the reflectivity decreases. It may also be noted that as the mass density of the individual toner formulations A, B, C increases, the reflectance ratio begins to plateau or become saturated, such that the effects of the underlying layer may become negated.

The calculated toner mass density "x" may then be cross-referenced with a look-up table for a particular toner formulation that correlates mass density to darkness or lightness. In the CIE (International Commission on Illumination) color space, for example, darkness/lightness may be expressed as L*, wherein an L* of 0 represent black and 100 represents white. In addition, in the CIE colorspace a* may indicate a position between magenta and green and b* may indicate a position between yellow and blue. The process parameters of the image forming device may then be adjusted to adjust the mass density. Such process parameters may again, include voltages of either the photoconductor, the discharged portion of the photoconductor, or the developer roller.

One may therefore appreciate, referring back to FIG. 2, that at lower toner mass densities, the reflectance ratio is relatively low, because the underlying surface, in this case the control surface or intermediate transfer belt, absorbs greater than 90% of the incident light. As the toner mass density increases, the toner begins to "hide" the control surface and reflect or absorb more of the light until a point is reached where the reflectivity begins to level off. At this point, a sufficient thickness of toner has been applied to the control surface such that the light may be either completely absorbed or reflected by the toner. Little or no incident light may be transmitted to the control surface.

Figure 3:
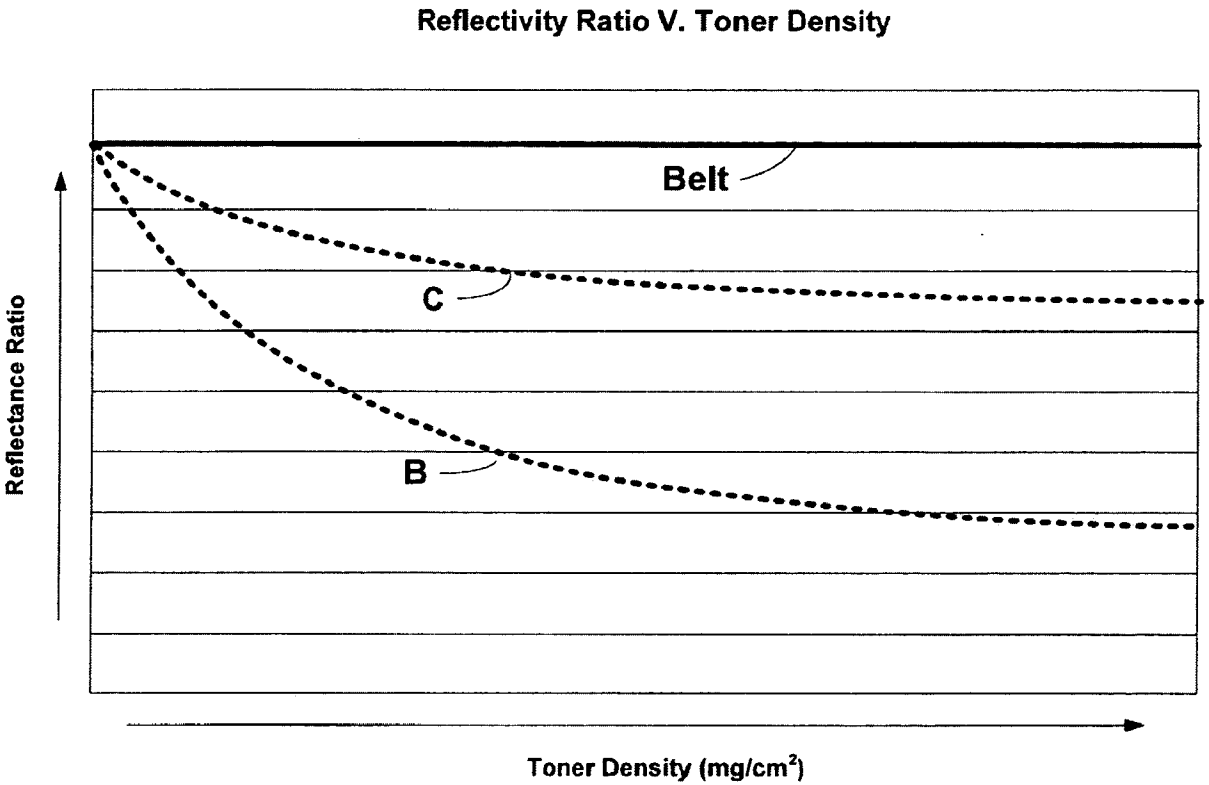
FIG. 3 is a graph illustrating an exemplary relationship between toner density and reflectivity.

It may also be appreciated that if the underlying substrate reflected most of the light, i.e., if the underlying substrate reflected 90% of the light, curves B and C would be inversed and the curve for the relatively absorptive toner B would indicate a much greater change in the ratio of reflectivity then the curve for the relatively reflective toner C, as illustrated in FIG. 3.

Consistent with the above, a given toner formulation may generally include a resin and a colorant (e.g. pigment) as well as various additives. It should be noted that reference herein to the term colorant is intended to be inclusive of any composition that provides a given color. In that regard it is intended to include either a pigment, which may typically be solid particulate, as well as a dye, which may typically be in liquid form. The resin itself may generally be relatively transparent to infrared light. However, various additives in the formulation, including some colorants may reduce the transparency, i.e., the additives may cause absorption of at least a portion of incident infrared light.

It should therefore be appreciated that while the control surface may absorb a substantial portion of the infrared light emitted from the sensor at a given wavelength, most color toner formulations, i.e., cyan, magenta, or yellow formulations, may be relatively transmissive and may reflect at least a portion of the incident infrared light emitted from the sensor at the given wavelength. Such relatively reflective toner may reflect 25% or more of the incident infrared light of a given wavelength emitted by the sensor when the toner is at saturation, including all values and increments in the range of about 25 to 99% of the incident light.

In the case of black toner, for example, a common additive or colorant may include carbon black. Carbon black, like other absorptive additives, may adsorb a portion of the incident light of a given wavelength in the infrared spectrum emitted from the toner patch sensor. Carbon black may be present in a toner formulation in the range of 0.25 to 6 percent by weight. Additions of carbon black at levels of greater than 6 percent by weight may cause a very small or zero toner patch sensor response with respect to changes in toner density.

Black toner, however, is not the only toner formulation that may include absorptive additives and a similar effect may be seen with respect to color toner formulations that may include infrared absorptive additives. Accordingly, the calibration techniques and apparatus used herein may be similarly applied for black or color toner formulations including absorptive additives. Such relatively absorptive toner formulations (black or color formulations) may reflect less than 25% of incident light emitted by a toner patch sensor when the toner is at saturation, including all values and increment in the range of about 1 to 25%. Therefore, it may be appreciated that in some circumstances the relative reflectivity of the absorptive toner $R_1$ at saturation or in bulk may be less than that of the reflective toner $R_2$ at saturation or in bulk, i.e., $R_1<R_2$.

In an exemplary embodiment of performing toner patch measurements, the toner formulations may be deposited in a test pattern or in a series of patches on a control surface. The relatively absorptive toner, i.e., black or color toner including absorptive additives, may be deposited directly onto the control surface in a first patch. Substantially the same amount, i.e., within +/−5% by weight, of the absorptive toner may also be deposited onto another, relatively reflective toner, to form a second, combined toner patch. In addition, the relatively reflective toner may be deposited directly onto the control surface at substantially the same amount, i.e., within +/−5% by weight of the underlayer of the combined toner patch, forming a third patch. It should be appreciated that the relatively reflective toner and the control surface should exhibit reflectivities that are not equal when measured by a toner patch sensor. Thus, signals indicating the reflectance of each patch, i.e., the first patch including the relatively absorptive toner, the second patch including the relatively absorptive over relatively reflective toner, and the third patch including the relatively reflective toner, may be measured along with a signal indicating the reflectivity of the control surface, e.g., the intermediate transfer belt. Where a number of measurements of various mass densities of the relatively absorptive toner may be desired, a plurality of the first and second patch may be provided and measured. In addition, for each first and second patch, a third patch may be provided and measured and the control surface may be measured. Alternatively, for a plurality of the first and second patches, a single third patch may be provided and measured and a single measurement of the control surface may be performed.

As previously noted, such signal indicating the reflectivity may be measured by an optical detector which may then provide a voltage or other signal correlating to the amount of reflectivity of the toner, i.e., the greater the reflectivity, the higher the voltage, or vice versa. The above, therefore provides at least two baseline voltages and at least two points for measuring the reflectivity of relatively absorbent toner formulations. From this information, and the above equations, one may compare the toner patch signals for the relatively absorptive formulation deposited over the relatively reflective formulation and for the relatively absorptive formulation deposited over the belt, using the below equation:

$$\frac{R_{a/r} - R_a}{R_r - R_{control}} = \text{Ratio}\,(A{:}B)$$

wherein $R_{a/r}$ may be a signal indicative of the reflectivity for the relatively absorptive toner deposited over the relatively reflective toner, $R_a$ may be a signal indicative of the reflectivity for the relatively absorptive toner, $R_r$ may be a signal indicative of the reflectivity for the relatively reflective toner and $R_{control}$ may be a signal indicative of the reflectivity for the belt or other control surface, wherein $R_r \neq R_{control}$. Once again, the signal may include a voltage or other indicator.

Calculated Ratio (A:B) may be compared with a selected value for Ratio (A:B) and operating parameters may be adjusted to provide a calculated Ratio (A:B) within a desired range of selected Ratio (A:B). The selected Ratio (A:B) may correlate to a desired darkness, which may be dictated by the requirements of the image to be printed. For example, Ratio (A:B), calculated or selected, may be in the range of 0 to 1, wherein 1 may indicate little to no absorptive toner deposited. A value approaching zero may indicate that the absorptive toner may be nearly saturated.

In accordance with the above, a number of toner patches including varying amounts of the relatively absorptive toner, for example, may be deposited by varying the operating parameters, to calculate a range of Ratio (A:B), from 0 to 1. Such patches having varying amounts or mass density of the relatively absorptive toner may be produced by altering the operating parameters as the patches are deposited, so that each set of patches, i.e., first and second patches containing the relatively absorptive toner, may include a different mass density. Such varying mass densities, for example, may correlate to different points on the darkness scale.

In addition, the indicated reflectivity of the belt or control surface may be considered and a similar calculation may be performed with respect to the reflectivity ratio of each patch according to the following equation.

$$\frac{RR_{a/r} - RR_a}{RR_r - RR_{control}} = \text{Ratio}\,(A{:}B)$$

wherein $RR_{a/r}$ may be the ratio of the signal indicating the reflectivity of the relatively absorptive toner deposited over the relatively reflective toner to the signal indicating the reflectivity of the control surface, $RR_a$ may be the ratio of the signal indicating the reflectivity of the relatively absorptive toner to the signal indicating the reflectivity of the control surface, $RR_r$ may be the ratio of the signal indicating the reflectivity of the relatively reflective toner to the signal indicating the reflectivity of the control surface and $RR_{control}$ may be ratio of the signal indicating the reflectivity of the control surface to itself.

Figure 4:
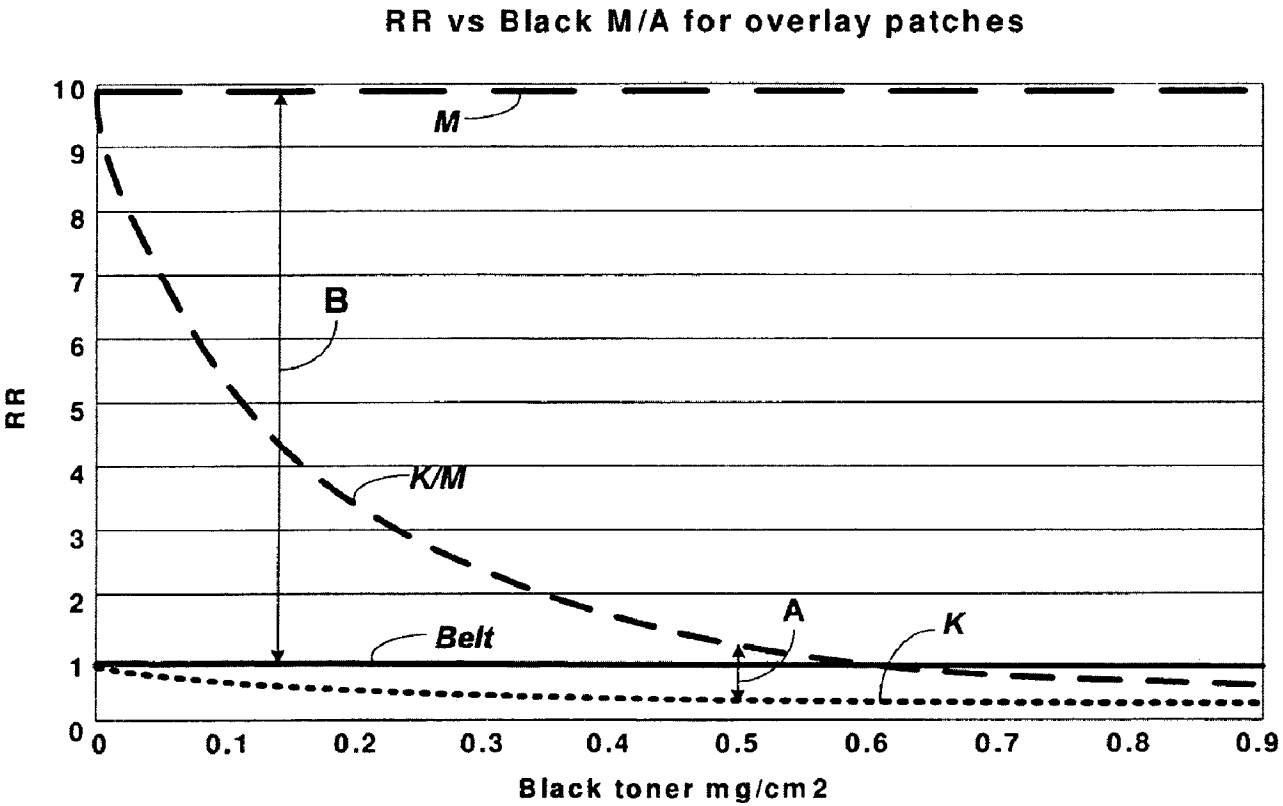
FIG. 4 is a graph illustrating exemplary relationships between toner density and reflectivity for relatively absorptive toner deposited over a belt and relatively absorptive toner deposited over a relatively reflective toner.

FIG. 4 illustrates an exemplary plot of the reflectivity ratio v. toner density of an exemplary black toner formulation deposited over a belt and a magenta toner control surface at various operating parameters. As can be seen from the figure, the black toner patch reflectivity ratio K decreases with increased black toner density. The reflectivity ratio of the magenta toner patch M remains constant as the magenta toner patch, which is relatively reflective, were applied at a constant thickness. In addition, the reflectivity ratio of the black over magenta toner patch K/M decreases and approaches that of the black toner patch over the belt as the black toner density over the saturated magenta toner patch increases. Furthermore, the reflectivity ratio of the underlying belt remains constant. As can be seen in the figure, the reflectivity of the magenta layer M and the reflectivity of the belt surface ("Belt") may provide two baselines from which the reflectivity of the black toner K maybe evaluated. Furthermore, as illustrated in the figure, the reflectivity of the magenta layer M may be greater than the belt "Belt."

As noted above, the example herein may apply not only to black toner, but to other toners which may be absorptive in the infrared spectrum due to, for example, additives. Other toners may be used as the underlying layer as well, such as cyan or yellow toner formulations. In addition, the underlying layer may be substantially reflective, as illustrated in FIG. 3, and the belt reflectivity may be greater than that of one or more of the toner compositions.

Referring back to Ratio (A:B), such ratio may also be adjusted by comparison to bulk reflectivity measurements indicating the saturated reflectivity, $R_{sat}$, of a given toner formulation, wherein the reflectivity data with respect to the toner formulation, including $R_{sat}$ or other factors, may be provided in the storage device of the cartridge described above. The operating parameters may then be adjusted based on the calculated Ratio (A:B) and factors provided in the storage device to adjust the printed L* value.

Furthermore, the reflectivity at saturation for the relatively absorptive toner may be back calculated from the above equations. For example, by using a pair of patches, i.e., one relatively absorptive on relatively reflective toner and the other relatively absorptive on belt, and assuming equal attenuation of the underlying reflective toner or belt by a black patch of a given mass density (mass/area), the saturated reflectivity may be determined as noted in the following derivation.

$$\frac{R_a - R_{sat}}{R_{belt} - R_{sat}} = \frac{R_{a/r} - R_{sat}}{R_r - R_{sat}}$$

$$R_{sat} = \frac{R_{a/r}R_{belt} - R_a R_r}{R_{a/r} + R_{belt} - R_a - R_r}$$

Once again R may represent a measured voltage or other signal indicative of the reflectivity of the various patches or belt.

Figure 5:
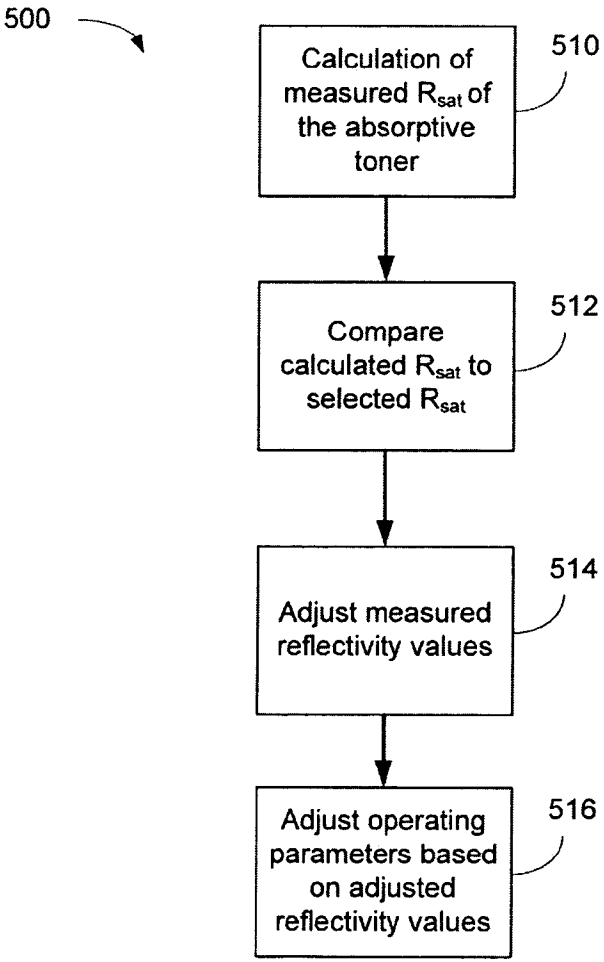
FIG. 5 is a flow chart of an exemplary methodology for adjusting reflectivity measurements based on a comparison of absolute reflectivity to a calculated reflectivity.

The calculated saturated reflectivity of the absorptive toner may then be used for calibrating the reflective toner. That is, the measured error or difference between the calculated and selected reflectivity for the absorptive toner may then be used to adjust toner patch sensor measurements and operating parameters with respect to the various toner compositions, including relatively reflective toner compositions. For example, in an exemplary embodiment illustrated in FIG. 5, using the equations above, one may calculate $R_{sat}$ for the absorptive toner at 510. Calculated $R_{sat}$ may then be compared to a selected $R_{sat}$ at 512 and the difference between the two values may be assessed. The difference in $R_{sat}$ may then be used to adjust the measured reflectivity values at 514. Once such accommodation is made, the operating parameters with respect to the relatively reflective toner formulations may then be adjusted to desired or selected values on a color scale, such as L* at 516. The given methodology 500 may be implemented in a processor or provided in a computer program, as further described below. Once again, as noted above, the bulk reflectivity of the toner formulation may be measured and supplied using, for example, an identifier on a toner cartridge such as a signature chip or a barcode, providing the absolute saturated reflectivity for a given toner composition.

Various other factors with respect to the measurements may be considered and accommodated for. For example, one may appreciate, that in applying the relatively absorptive toner layer to an underlying and relatively reflective toner layer, some back transfer of the underlying toner layer to the photoconductor may occur. Such back transfer losses may be in the range of up to about 10% of the toner mass deposited. However, the back transfer may be accommodated for by adjusting or scaling up the reflectivity values for the underlying toner patches, or by providing an underlying layer that may be thick enough to accommodate for the losses regardless of the toner back transferred. The correction factor may be a function of environment, i.e., temperature or humidity, as well as toner age, photoconductor cycles, etc.

In an exemplary embodiment, the calibration performed herein may be accomplished by a processor found in the controller of the image forming device. The controller may communicate with and receive signals/data from the storage devices on the cartridge and the toner patch sensor. The data received may be referenced to a series of lookup tables provided in memory located in the image forming device, a toner cartridge for use with the image forming device or in a computer which may be in communication with the image forming device.

It should now also be clear that embodiments of the methods described above may be implemented in a computer program that may be stored on a storage medium having instructions to program a system to perform the methods. The storage medium may include, but is not limited to, any type of disk including floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, magnetic or optical cards, or any type of media suitable for storing electronic instructions. Other embodiments may be implemented as software modules executed by a programmable control device.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method for calibrating an image forming device using a toner patch sensor which emits and detects light at a given wavelength in the infrared spectrum comprising:

depositing a plurality of toner patches onto a control surface, wherein said toner patches include a first toner patch including a black toner, a second toner patch including said black toner deposited over a non-black toner, and a third toner patch including said non-black toner;

measuring signals indicative of the reflectivity of said plurality of toner patches and the reflectivity of said control surface by emitting light of a given wavelength in the infrared spectrum and detecting the amount of incident light reflected from said plurality of toner patches and said control surface, wherein said first toner patch exhibits a first reflectivity $R_1$ at said given wavelength, said second toner patch exhibits a second reflectivity $R_2$ at said given wavelength, said third toner patch exhibits a third reflectivity $R_3$ at said given wavelength, said control surface exhibits a fourth reflectivity $R_{control}$ at said given wavelength, wherein $R_{control} \neq R_3$; and adjusting an operating parameter based upon said measurements.

2. The method of claim 1, further comprising determining a ratio (Ratio A:B) according to the following relationship:

$$\frac{R_2 - R_1}{R_3 - R_{control}} = \text{Ratio}(A{:}B)$$

and adjusting an operating parameter of said image forming device based on said ratio.

3. The method of claim 2, wherein said adjusting of an operating parameter comprises comparing said ratio to a selected value for Ratio (A:B).

4. The method of claim 1, further comprising determining a toner mass density (mass/area) of said black toner based on said signals indicative of the reflectivity of said plurality of toner patches and said control surface.

5. The method of claim 1, further comprising determining a reflectivity ratio for said plurality of toner patches and said control surface, wherein said reflectivity ratio is the ratio of at least one of said signals indicative of the reflectivity of one of said plurality of toner patches or said control surface to at least one of said signals indicative of the reflectivity of said control surface; and determining said ratio (Ratio A:B) according to the following relationship:

$$\frac{RR_2 - RR_1}{RR_3 - RR_{control}} = \text{Ratio}(A{:}B),$$

wherein $RR_2$ is the reflectivity ratio of said second toner patch, $RR_1$ is the reflectivity ratio of said first toner patch, $RR_3$ is the reflectivity ratio of said third toner patch and $RR_{control}$ is the reflectivity ratio of said control surface and Ratio (A:B) is in the range of 0 to 1.

6. The method of claim 1, further comprising calculating a calculated saturated reflectivity ($R_{sat}$) for said black toner according to the following relationship:

$$R_{sat} = \frac{R_2 R_{control} - R_1 R_3}{R_2 + R_{control} - R_1 - R_3}$$

comparing said calculated $R_{sat}$ to a selected $R_{sat}$;

determining a difference between the calculated $R_{sat}$ and the selected $R_{sat}$; and adjusting an operating parameter relating to said non-black toner and optionally an additional toner based on said difference in said calculated $R_{sat}$ and said selected $R_{sat}$.

7. The method of claim 1, wherein said plurality of toner patches includes a plurality of said first toner patch, a plurality of said second toner patch and at least one of said third toner patch and measuring signals indicative of the reflectivity of each of said plurality of said first and second toner patches relative to signals indicative of the reflectivity of said at least one third toner patch and said control surface.

8. The method of claim 7, wherein said black toner is deposited in said plurality of said first and second toner patches at varying operating parameters.

9. The method of claim 1, wherein said toner patches including a plurality of said first toner patch, a plurality of said second toner patch and a plurality of said third toner patch, and measuring signals indicative of said reflectivity of each of said plurality of said first, second and third toner patches relative to signals indicative of reflectivity of said control surface.

10. The method of claim 9 wherein said black toner is deposited in said plurality of said first and second toner patches at varying operating parameters.

11. The method of claim 1, wherein said first toner exhibits a first reflectivity at saturation $R_{sat1}$ and said non-black toner exhibits a second reflectivity at saturation $R_{sat2}$, wherein $R_{sat1} < R_{sat2}$.

12. The method of claim 1, wherein $R_3 > R_{control}$.

13. The method of claim 1, wherein said operating parameter selected from the group of discharge intensity, photoconductor charge, developer roller bias and combinations thereof.

14. A system for calibrating an image forming device comprising:

a light source illuminating a plurality of toner patches deposited on a control surface at a given wavelength in the infrared region including a first toner patch including a black toner, a second toner patch including said black toner deposited over a non-black toner, and a third toner patch including said non-black toner;

a detector providing signals indicative of the reflectivity of said plurality of toner patches and said control surface at said given wavelength; and a controller including a processor in communication with said detector, wherein said processor performs:

receiving said signals from said detector indicative of the reflectivity of said plurality of toner patches and said control surface;

wherein said first toner patch exhibits a first reflectivity $R_1$ at said given wavelength, said second toner patch exhibits a second reflectivity $R_2$ at said given wavelength, said third toner patch exhibits a third reflectivity $R_3$ at said given wavelength, said control surface exhibits a fourth reflectivity $R_{control}$ at said given wavelength, wherein $R_{control} \neq R_3$; and adjusting an operating parameter of said image forming device based on said measurements.

15. The system of claim 14, wherein said processor is further capable of determining a ratio (Ratio A:B) according to the following relationship:

$$\frac{R_2 - R_1}{R_3 - R_{control}} = \text{Ratio}(A{:}B)$$

and adjusting an operating parameter of said image forming device based on said ratio.

16. The system of claim 15, wherein said adjusting of an operating parameter comprises comparing said ratio to a selected value for Ratio (A:B).

17. The system of claim 14, wherein said processor is further capable of determining a toner mass density (mass/area) of said black toner based on said signals indicative of the reflectivity of said plurality of toner patches and said control surface.

18. The system of claim 14, wherein said processor is further capable of determining a reflectivity ratio for said plurality of toner patches and said control surface, wherein said reflectivity ratio is the ratio of at least one of said plurality of signals indicative of the reflectivity of said plurality of toner patches or said control surface to at least one of said signals indicative of said reflectivity of said control surface; and determining said ratio (Ratio A:B) according to the following relationship:

$$\frac{RR_2 - RR_1}{RR_3 - RR_{control}} = \text{Ratio}\,(A{:}B),$$

wherein $RR_2$ is the reflectivity ratio of said second toner patch, $RR_1$ is the reflectivity ratio of said first toner patch, $RR_3$ is the reflectivity ratio of said third toner patch and $RR_{control}$ is the reflectivity ratio of said control surface and Ratio (A:B) is in the range of 0 to 1.

19. The system of claim 14, wherein said processor is further capable of calculating a calculated saturated reflectivity ($R_{sat}$) for said black toner according to the following relationship:

$$R_{sat} = \frac{R_2 R_{control} - R_1 R_3}{R_2 + R_{control} - R_1 - R_3}$$

comparing said calculated $R_{sat}$ to a selected $R_{sat}$, determining a difference between the calculated $R_{sat}$ and the selected $R_{sat}$, and adjusting an operating parameter related to said non-black toner and optionally an additional toner based on said difference in said calculated $R_{sat}$ and said selected $R_{sat}$.

20. The system of claim 14, wherein said plurality of toner patches includes a plurality of said first toner patch, a plurality of said second toner patch and at least one said third toner patch and measuring signals indicative of the reflectivity of each of said plurality of said first and second toner patches relative to signals indicative of the reflectivity of said at least one third toner patch and said control surface.

21. The system of claim 20, wherein said black toner is deposited in said plurality of said first and second toner patches at varying operating parameters.

22. The system of claim 14, wherein said toner patches including a plurality of said first toner patch, a plurality of said second toner patch and a plurality of said third toner patch, and measuring signals indicative of said reflectivity of each of said plurality of said first, second and third toner patches relative to signals indicative of reflectivity of said control surface.

23. The system of claim 22, wherein said black toner is deposited in said plurality of said first and second toner patches at varying operating parameters.

24. The system of claim 14, wherein said system further comprises a photoconductor, a developer roller and a discharge device and wherein said operating parameter is selected from the group of discharge intensity, photoconductor charge, developer roller bias and combinations thereof.

25. The system of claim 14, wherein said black toner exhibits a first reflectivity at saturation $R_{sat1}$ and said non-black toner exhibits a second reflectivity at saturation $R_{sat2}$, wherein $R_{sat1}<R_{sat2}$.

26. The system of claim 14, wherein $R_3>R_{control}$.

27. A non-transitory article comprising a storage medium having stored thereon instructions that when executed by a machine result in the following in an image forming device:

depositing a plurality of toner patches onto a control surface, wherein said toner patches include a first toner patch including a black toner, a second toner patch including said black toner deposited over a non-black toner and a third toner patch including said non-black toner;

measuring signals indicative of the reflectivity of said plurality of toner patches and said control surface by emitting light of a given wavelength in the infrared spectrum and detecting the amount of incident light reflected from said plurality of toner patches and said control surface;

wherein said first toner patch exhibits a first reflectivity $R_1$, said second toner patch exhibits a second reflectivity $R_2$, and said third toner patch exhibits a third reflectivity $R_3$, and said control surface exhibits a reflectivity $R_{control}$, wherein $R_{control}\neq R_3$; and adjusting an operating parameter of said image forming device based on said measurements.

28. The apparatus of claim 27, wherein said instructions that when executed by said machine result in the following additional operations: determining a ratio (Ratio A:B) according to the following relationship:

$$\frac{R_2 - R_1}{R_3 - R_{control}} = \text{Ratio}\,(A{:}B)$$

and adjusting an operating parameter of said image forming device based on said ratio.

29. The article of claim 28, wherein said adjusting of an operating parameter comprises comparing said ratio to a selected value for Ratio (A:B).

30. The article of claim 27, wherein said instructions that when executed by said machine result in the following additional operations: determining a toner mass density (mass/area) of said black toner based on said signals indicative of the reflectivity of said plurality of toner patches and said control surface.

31. The article of claim 27, wherein said instructions that when executed by said machine result in the following additional operations: determining a reflectivity ratio for said plurality of toner patches and said control surface, wherein said reflectivity ratio is the ratio of at least one of said signals indicative of the reflectivity of one of said plurality of toner patches or said control surface to at least one of said signals indicative of the reflectivity of said control surface; and determining said ratio (Ratio A:B) according to the following relationship:

$$\frac{RR_2 - RR_1}{RR_3 - RR_{control}} = \text{Ratio}\,(A{:}B),$$

wherein $RR_2$ is the reflectivity ratio of said second toner patch, $RR_1$ is the reflectivity ratio of said first toner patch, $RR_3$ is the reflectivity ratio of said third toner patch and $RR_{control}$ is the reflectivity ratio of said control surface and Ratio (A:B) is in the range of 0 to 1.

32. The article of claim 27, wherein said instructions that when executed by said machine result in the following additional operations: calculating a calculated saturated reflectivity $R_{sat}$ for said black toner according to the following relationship:

$$R_{sat} = \frac{R_2 R_{control} - R_1 R_3}{R_2 + R_{control} - R_1 - R_3}$$

comparing said calculated $R_{sat}$ to a selected $R_{sat}$, determining a difference between the calculated $R_{sat}$ and the selected saturated $R_{sat}$ and adjusting an operating parameter related to said non-black toner and optionally an additional toner based on said difference between said calculated $R_{sat}$ and said selected $R_{sat}$.

33. The article of claim 27, wherein said black toner exhibits a first reflectivity at saturation $R_{sat1}$ and said non-black toner exhibits a second reflectivity at saturation $R_{sat2}$, wherein $R_{sat1}<R_{sat2}$.

34. The article of claim 27, wherein $R_3>R_{control}$.

35. The article of claim 27, wherein said operating parameter is selected from the group of discharge intensity, photoconductor charge, developer roller bias and combinations thereof.

36. A method for calibrating an image forming device using a toner patch sensor which emits and detects light at a given wavelength in the infrared spectrum comprising:

depositing a plurality of toner patches onto a control surface, wherein said toner patches include a first toner patch including a black toner, a second toner patch including said black toner deposited over a non-black toner and a third toner patch including said non-black toner;

measuring signals indicative of the reflectivity of said plurality of toner patches and the reflectivity of said control surface by emitting light of a given wavelength in the infrared spectrum and detecting the amount of incident light reflected from said plurality of toner patches and said control surface, determining a calculated saturated reflectivity ($R_{sat}$) according to the following relationship:

$$R_{sat} = \frac{R_2 R_{control} - R_1 R_3}{R_2 + R_{control} - R_1 - R_3}$$

wherein $R_1$ is a signal indicative of the reflectivity of said first toner patch, $R_2$ is a signal indicative of the reflectivity of said second toner patch, $R_3$ is a signal indicative of the reflectivity of said third toner patch and $R_{control}$ is a signal indicative of the reflectivity of said control surface, wherein $R_{control}\neq R_3$; and adjusting an operating parameter of said image forming device based on said calculated $R_{sat}$.

37. The method of claim 36, wherein said calculated $R_{sat}$ is for said black toner and said method further comprises:

comparing said calculated $R_{sat}$ for said black toner to a selected $R_{sat}$ for said black toner;

determining a difference between the calculated $R_{sat}$ and the selected $R_{sat}$ and adjusting an operating parameter related to said non-black toner and optionally an additional toner based on said difference in calculated $R_{sat}$ and said selected $R_{sat}$.

38. The method of claim 36, wherein said black toner exhibits a first reflectivity at saturation $R_{sat1}$ and said non-black toner exhibits a second reflectivity at saturation $R_{sat2}$, wherein $R_{sat1}<R_{sat2}$.

39. The method of claim 36, wherein $R_3>R_{control}$.

* * * * *